US008550280B2

(12) United States Patent
Steuer

(10) Patent No.: US 8,550,280 B2
(45) Date of Patent: Oct. 8, 2013

(54) SEALED CONTAINER WITH INTEGRAL BUTTON AND ORIFICE SEAL

(76) Inventor: Paul R Steuer, Hawthorn Woods, IL (US)

( * ) Notice: Subject to any disclaimer, the term of this patent is extended or adjusted under 35 U.S.C. 154(b) by 333 days.

(21) Appl. No.: 12/856,393

(22) Filed: Aug. 13, 2010

(65) Prior Publication Data

US 2012/0037651 A1 Feb. 16, 2012

(51) Int. Cl.
*B65D 51/16* (2006.01)

(52) U.S. Cl.
USPC ..... 220/203.01; 220/715; 220/714

(58) Field of Classification Search
USPC ..... 220/714, 715, 717; 215/387
See application file for complete search history.

(56) References Cited

U.S. PATENT DOCUMENTS

| | | | | |
|---|---|---|---|---|
| 3,964,631 | A | 6/1976 | Albert | |
| 3,967,748 | A | 7/1976 | Albert | |
| 3,972,443 | A | 8/1976 | Albert | |
| 4,094,433 | A | 6/1978 | Numbers | |
| 4,099,642 | A | 7/1978 | Nergard | |
| 4,133,446 | A | 1/1979 | Albert | |
| 4,212,408 | A | 7/1980 | Valenzona | |
| 5,485,938 | A | 1/1996 | Boersma | |
| 5,918,761 | A | 7/1999 | Wissinger | |
| 6,098,834 | A * | 8/2000 | Hatsumoto et al. | 220/715 |
| 7,537,134 | B2 | 5/2009 | Lee | |
| 7,546,933 | B2 | 6/2009 | Pinelli | |
| 2005/0029265 | A1 | 2/2005 | Morgan et al. | |
| 2007/0210093 | A1 | 9/2007 | Pinelli | |

OTHER PUBLICATIONS

International Search Report under PCT Article 18 and Rules 43 and 44 by Korean Intellectual Property Office for International application No. PCT/US2011/044599, mailed Mar. 7, 2012, pp. 1-3.
Written Opinion of the International Searching Authority under PCT Rule 43bis.1 by Korean Intellectual Property Office for International application No. PCT/US2011/044599, mailed Mar. 7, 2012, pp. 1-7.
International Preliminary Report on Patentability under PCT Rule 44bis by Korean Intellectual Property Office for International application No. PCT/US2011/044599, mailed Feb. 19, 2013, pp. 1-8.

* cited by examiner

*Primary Examiner* — J. Gregory Pickett
*Assistant Examiner* — Raven Collins
(74) *Attorney, Agent, or Firm* — Patents and Licensing LLC; Daniel W Juffernbruch

(57) ABSTRACT

A cover assembly is capable of attaching to a container and has a dispensing orifice and a substantially perpendicular button opening on a side with a button. A single piece valve beam formed of a deflectable material has the actuator button located on one end and a fulcrum located on another end opposite the actuator button. An inner region of the cover has a retention surface opposite the button accommodating the fulcrum. The single piece valve beam is held inside the inner region of the cover between the button opening and the retention surface by deflection of the beam and rotation about the fulcrum such that the sealing surface moves away from the dispensing orifice when the actuator button is pressed. The deflectable material of the single piece valve beam acts as a spring that exerts force on the sealing surface and exerts force on the actuator against the button opening. The single piece valve beam can be configured to move away from the dispensing orifice when the button is pressed. An integral arm can be alternately cantilevered off of the single piece valve beam so the arm rotates in a same direction as the single piece valve beam rotates at the fulcrum. The arm can be alternatively cantilevered from a stem location so the arm rotates in a direction opposite a direction to which the single piece valve beam rotates at the fulcrum.

23 Claims, 6 Drawing Sheets

SEALED CONTAINER WITH INTEGRAL BUTTON AND ORIFICE SEAL

BACKGROUND OF THE INVENTIONS

1. Technical Field

The present inventions relate to sealed vessels and, more particularly, relate to a sealed vessel which is opened for drinking or pouring by pressing an actuator of a valve assembly.

2. Description of the Related Art

Covers for drinking containers that form a sealed vessel and provide a button to be pressed to drink or pour the liquid from the vessel are known to the art. These covers could be used to prevent spilling for urban commuters, especially when placed in a back pack next to an electronic device. In order to open the vessel to drink, an actuator was pressed on the opposite side of the drinking orifice which opened the drinking orifice. Most of the actuators were associated with several mechanisms to change the horizontal movement of the actuator into a vertical movement needed to open the drinking orifice and to provide the spring force to seal both the actuator and the drinking orifice. Once the actuator was pressed, the user could drink from the container through a drinking orifice. After taking a drink, the actuator was released and the container was sealed to prevent leakage. Kenneth J Albert has several patents which illustrate variations of this mechanism (U.S. Pat. No. 3,964,631) (U.S. Pat. No. 3,972,443).

One problem associated with these drinking containers was the number of mechanisms required to provide the movement and provide the necessary spring force. First, the cost to manufacture and assemble multiple pieces increased the cost of a cover assembly for the container. Since liquid also flowed over the valve, the valve needed to be cleaned, which was difficult with so many pieces. In some cases, the mechanism was so complex that the valve assembly could not be removed and could only be cleaned by a dishwashing machine which allowed for an accumulation of undesirable matter. U.S. Pat. No. 7,546,933 is an example of a complex valve assembly which could not be cleaned or removed for cleaning.

Another version of the art of a commonly available product was the pull ring on the center of the cover of the drinking container. A nipple in the middle, when pressed down was sealed, when the nipple is pulled up, the liquid was able to flow through the nipple. Although a simple solution, the valve wore out over time and leaked. Also, the inside of the nipple could not be manually cleaned and the nipple could not be removed. This type of valve was common on disposable containers as well because of the low cost to produce.

Richard Lee (U.S. Pat. No. 7,537,134) constructed a valve using an elongated arm to provide both the seal and the spring force to maintain the seal of the orifice plug. Squeezing the container together pulled the arm down by a string attached to a flexible bridge to open the drinking orifice. Like the aforementioned approaches, an arrangement of several mechanisms changed horizontal motion into vertical motion and the problem of cleaning was not resolved.

There exists a need for a cover assembly for a drinking container that forms a sealed vessel which can be opened by pressing an actuator for a valve mechanism and which can be easily removed and cleaned.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

The details of the preferred embodiments will be more readily understood from the following detailed description when read in conjunction with the accompanying drawings wherein.

DETAILED DESCRIPTION OF THE PREFERRED EMBODIMENTS

The present invention is illustrated by way of example and is not limited by the accompanying figures, in which like references indicate similar elements. Elements in the figures are illustrated for simplicity and clarity and have not necessarily been drawn to scale.

Figure 1:
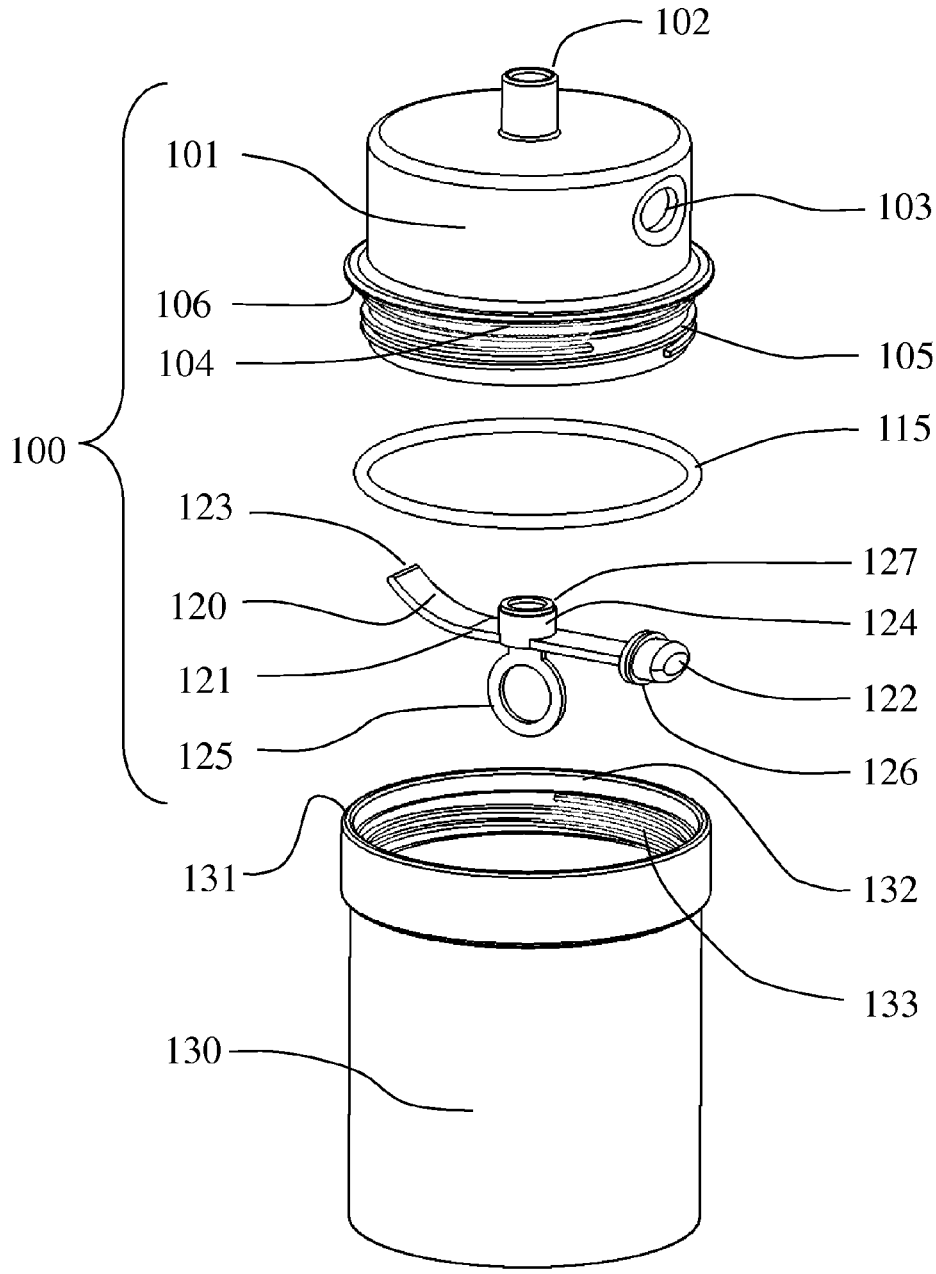
FIG. 1 illustrates an exploded perspective view of a vessel with a valve of a first, center orifice embodiment according to the present inventions.

The details of the preferred embodiments will be more readily understood from the following detailed description when read in conjunction with the accompanying drawings wherein:

FIG. 1 illustrates an exploded perspective view of a vessel with a valve of a first, center orifice embodiment. A cover assembly 100 is adaptable to seal a container 130 such that the cover assembly 100 and container 130 form a leak-proof vessel in which a button 122 needs to be pressed to open an orifice 102 for drinking or pouring or dispensing. Besides sealing the container 130, the cover 101 has an orifice 102 for pouring or drinking and an opening 103 for the button. Internal to the cover 101 is a single piece valve beam 120 that acts as the actuator, the seal 126 to the button opening in the cover, and the seal 127 to the drinking orifice, while also being slightly deflected to act as a spring exerting force to seal the button opening 103 and the drinking orifice 102 of the cover. Once the button 122 of the valve beam is pressed with a finger, the valve beam 120 releases the seal 126 at the actuator and the beam 120 deflects which opens the drinking orifice 102.

The cover assembly 100 has a cover 101, container seal 115, and a single piece valve beam 120, in which the assembly is rotationally attached to a container 130. The cover 101 has an orifice 102 for drinking or pouring or dispensing, an opening 103 for an actuator button, sealing surface 104 for container seal, threads 105 for attaching to a container, and a stop surface 106 for thread engagement. Besides threads 105, there are other ways to attach the cover assembly to the container such as a snapping or press fitting. The container seal 115 forms a leak-proof seal between the cover 101 and the container 130. The container seal 115 is retained on the cover 101 by sliding over the cover threads 105 to locate on surface 104. The single piece valve beam 120 consists of a plastic beam 121 with an actuator button 122 on one end and a fulcrum 123 located on the other end. In the middle is a projection 124 for sealing the drinking orifice 102 of the cover and opposite the projection 124 is an access arm 125 for removing and inserting the valve beam. The access arm 125 is a handle formed of a size and shape capable of being grasped by the human hand. Elastic material forms a seal pad 126 that attaches to the plastic beam 121 near the button and on the middle projection 124 for sealing by another seal 127. The valve beam 120 assembles to the cover 101 by grasping the access arm 125 and initially inserting the fulcrum end 123 of the beam into the cover 101 and further pressing of the access arm 125 until the actuator button 122 snaps out of the button opening 103 of the cover. Once inserted, the valve beam 120 seals both the drinking orifice 102 and the button opening 103. The cover assembly 100 is attached to the container 130, which holds the media for drinking or pouring, with threads 105 from the cover mating with threads 133 from the container until the top 131 of the container meets the stop surface 106 of the cover and the container seal 115 is engaged with the container seal surface 132 to form a leak-proof vessel.

Another advantage of the present invention is that the single piece valve beam 120 can be easily removed for accessibility to all surfaces and easy cleaning. By pulling on the access arm 125 of the valve beam 120, the button 122 of the valve beam can be pulled through the actuator button opening 103 of the cover to release the valve beam 120. The cover 101 and the valve beam 120 can be either manually cleaned or cleaned by an automatic dish washer. The valve beam 120 is re-inserted by pushing the access arm 125 of the valve beam 120 into the cover 101 until the button 122 snaps through the button opening 103 in the cover thereby sealing the drinking orifice 102 and the button opening 103 in the cover.

Figure 2:
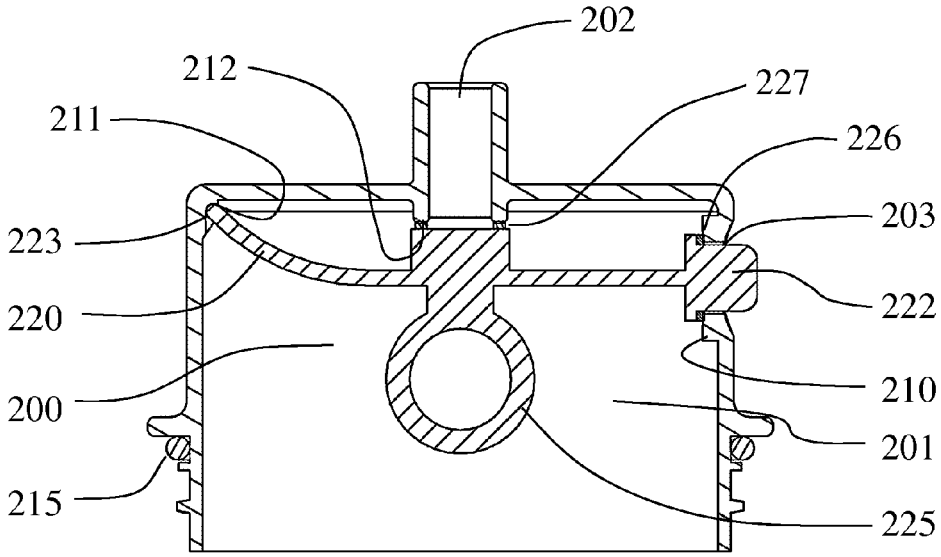
FIG. 2 illustrates a cross section plan view of a cover assembly through the valve beam of the first, center orifice embodiment in an unactuated mode according to the present inventions.
Figure 3:
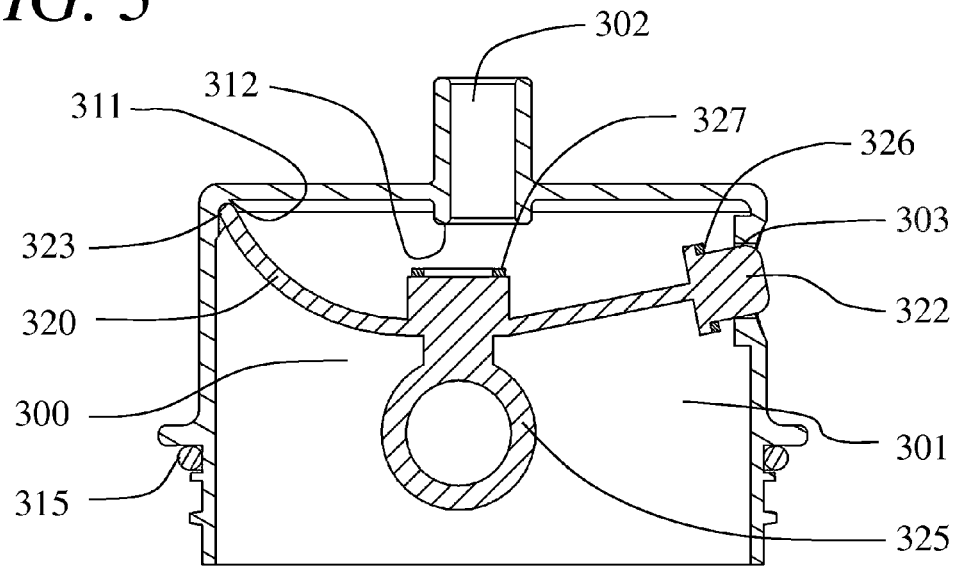
FIG. 3 illustrates a cross section plan view of a cover assembly through the valve beam of the first, center orifice embodiment in an actuated mode according to the present inventions.

FIG. 2 illustrates a cross section plan view of a cover assembly through the valve beam of the first, center orifice embodiment in an unactuated mode and FIG. 3 illustrates a cross section plan view of a cover assembly through the valve beam of the first, center orifice embodiment in an actuated mode. In the first, center orifice embodiment of FIGS. 2 and 3, the drinking orifice 202 is centrally located on the cover 201 such that the valve beam 220 deflects away from said drinking orifice 202 when the button 222 is pressed. The fulcrum end 223 of the valve beam presses against the inside wall of the cover at the inner fulcrum surface 211 located in a corner of an inner region on an inside of the cover furthest away from the button and the deflection of the valve beam 220 seals both the centrally located orifice 202 and the button opening 203. When the button 222 is pressed horizontally, the valve beam 220 releases the seal 226 from the actuator button opening 203 and also deflects vertically to open the drinking orifice 202.

The cover assembly 200 consists of the cover 201, single piece valve beam 220, and the container seal 215. An access arm 225 is a handle for removing and inserting the valve beam. Once inserted into the cover 201, the single piece valve beam 220 is positioned such that the button 222 extends through the button opening 203 in the cover with the button seal 226 pressed against the inner surface 210 of the button opening, the fulcrum 223 of the valve beam presses against the inner fulcrum surface 211 on the opposite wall of the inside of the cover, and the centrally located drinking orifice seal 227 presses against the inner drinking orifice surface 212. In this position, the single piece valve beam 220 is deflected between the button and the fulcrum end thereby providing the spring force to press the seals 226 and 227 against their respective surfaces. Since both the drinking seal 227 and the button seal 226 are made of elastic material, the drinking orifice 202 and the button opening 203 simultaneously seal from the deflection force. To achieve a leak-proof sealed vessel, the cover assembly 200 is threaded, or some other known method of attachment like snapping or friction fit, on a container such that the container seal 215 seals the container to the cover assembly.

The media within the container could be any pourable content such as a liquid like water or small solids like pellets. The embodiments discussed reference media, such as water, meant to be consumed by a user during a workout or carried along with the user at work to keep hydrated.

Although sealing is described above as leak-proof with an elastic material 226 and 227, the single piece valve beam 220 could be made without the elastic material and maintain a sealed vessel. If, for example, the media were pellets, then as long as the single piece valve beam 220 did not allow the pellets to pass through either the button opening or the drinking or pouring or dispensing orifice the resulting vessel would be a leak-proof seal. The amount of sealing required can also vary depending on intent. The vessel could be designed to only prevent splashing of the media from the vessel, thereby removing the need for elastic seals.

As shown in FIG. 3, the cover assembly 300 consists of the cover 301, single piece valve beam 320, and the container seal 315. An access arm 325 is a handle for removing and inserting the valve beam. The cover assembly can be rotationally attached to a container to form a sealed vessel with media such as water inside. To actuate the valve, the button 322 is pressed horizontally, which moves the button end of the single piece valve beam 320, releasing the seal 326 near the button which vents the sealed vessel and the fulcrum end 323 of the beam rotates about the inner fulcrum surface 311 located in a corner of an inner region on the inside of the cover causing further deflection of the beam 320 moving the seal 327 away from the inner drinking orifice surface 312 opening the centrally located drinking orifice 302. The media within the vessel can now be poured out of the drinking orifice 302 with the unsealed button opening 303 acting as a back vent for the released media. The vessel must be held by a user such that the button opening 303 is vertically higher than the drinking orifice when drinking to allow for the back venting. Releasing the button 322 returns the valve beam to the unactuated mode shown in FIG. 2.

Since the vessel could contain either hot or cold media, the pressure within the sealed vessel can change as the media changes temperature. If the media is hot, then the pressure within the sealed vessel decreases as the media cools, which pulls air into the vessel through the drinking orifice 302 or the button opening 303. If the media is cold, such as ice water, then the pressure within the sealed vessel increases over time as the media warms. This positive pressure can be released by unscrewing the cover 301 or pressing the button 322 during actuation. Since the button opening 303 opening surface area is smaller than the drinking orifice 302, the pressure releases first from the button opening 303 when the button 322 is actuated. If the pressure were released from the drinking orifice 302, then any liquid from drinking previously trapped between the outside of the drinking orifice 302 and the seal 327 would be sprayed out of the drinking orifice 302 when the button 322 is pressed in actuation. When the media is a carbonated beverage, this same positive pressure issue exists.

Figure 4:
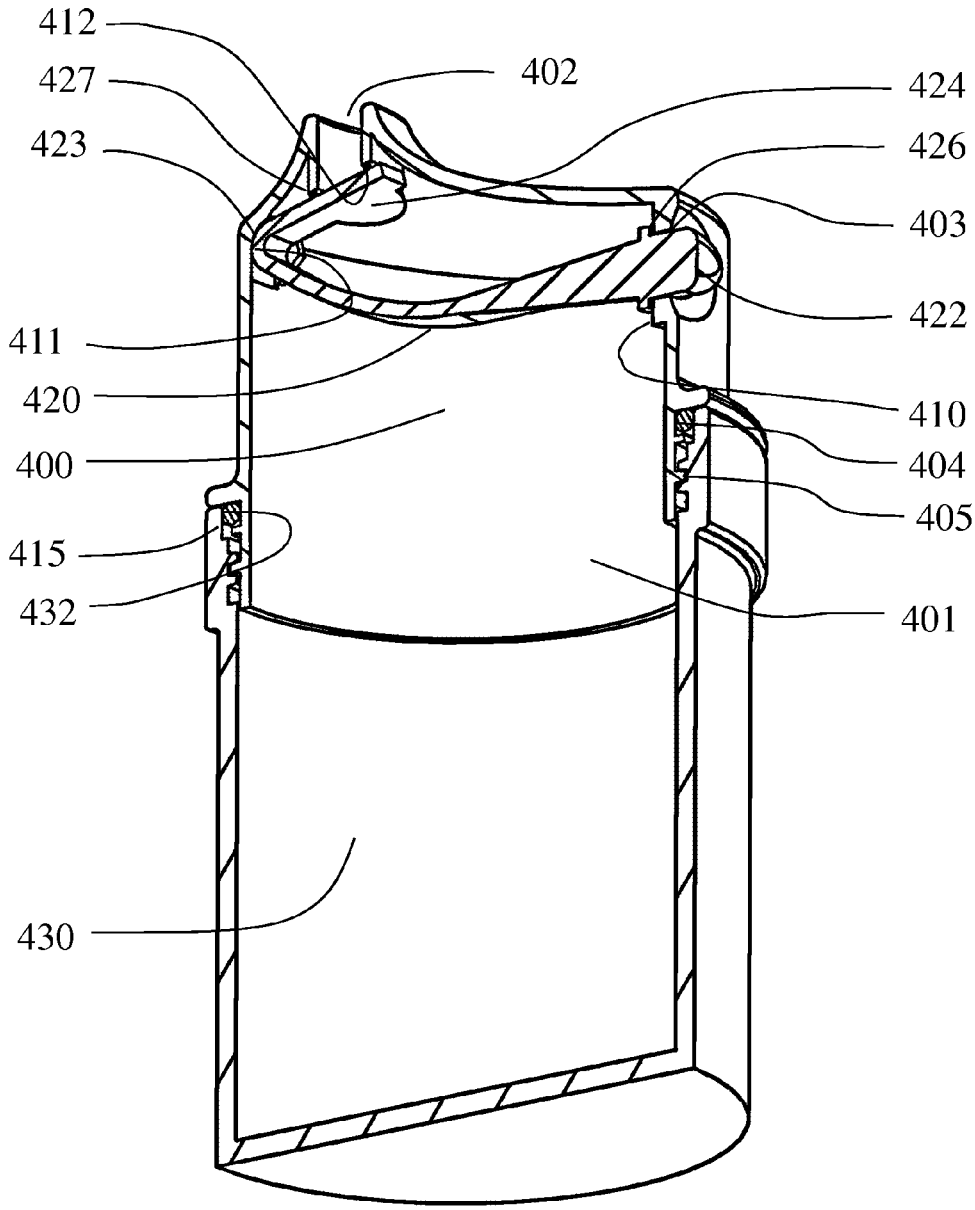
FIG. 4 illustrates a cross section perspective view of a vessel with a valve of a second, rotational embodiment in an unactuated mode according to the present inventions.
Figure 5:
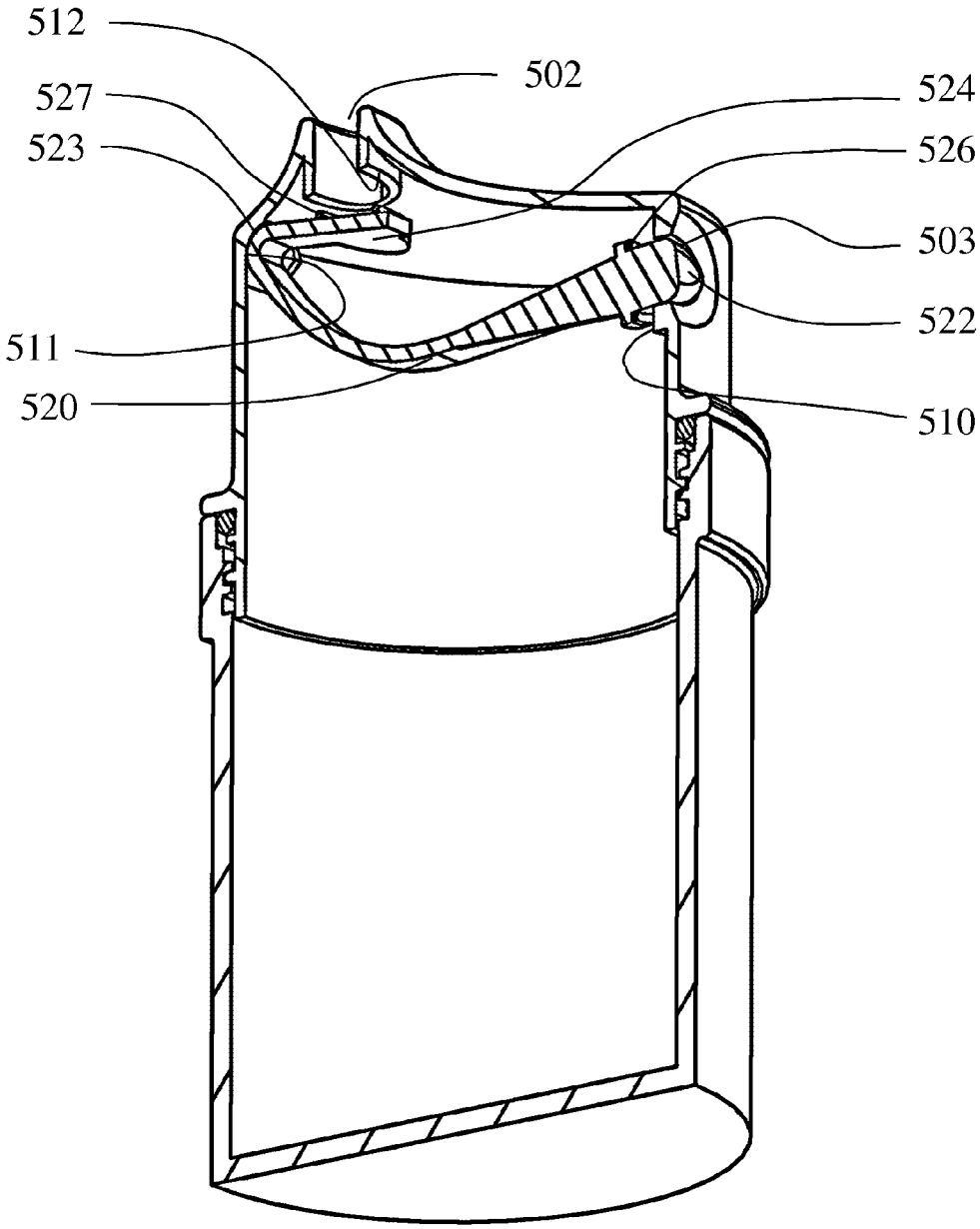
FIG. 5 illustrates a cross section perspective view of a vessel with a valve of the second, rotational embodiment in an actuated mode according to the present inventions.

FIG. 4 illustrates a cross section perspective view of a vessel with a valve of a second, rotational embodiment in an unactuated mode and FIG. 5 illustrates a cross section perspective view of a vessel with a valve of the second, rotational embodiment in an actuated mode. In the second, rotational embodiment of FIGS. 4 and 5, the drinking orifice 402 is transversely located from the button opening 403 in the cover and an extended arm 424 of the valve beam 420 rotates to open the drinking orifice 402 when the button 422 is pressed. The end of the valve beam furthest away from the actuator forms a fulcrum 423 which also has an extended arm 424 which seals the drinking orifice 402. The deflection of the valve beam 420 seals both the drinking orifice 402 and the button opening 403. When the button 422 is pressed horizontally, the valve beam 420 releases the seal 426 from the button opening 403 and rotates at the inner fulcrum surface 411 located in a corner of an inner region on an inside of the cover to open the drinking orifice 402.

In an unactuated mode as shown in FIG. 4, the cover assembly 400 consists of the cover 401, the single piece valve beam 420, and the container seal 415. The single piece valve beam 420 has a button 422 at one end with ledge for a seal 426 and on the opposite end is a fulcrum 423 with an extended arm 424 for the orifice seal 427. The single piece valve beam 420 is positioned within the cover 401 such that the button 422 extends through the button opening 403 in the cover with the button seal 426 pressing against the inner surface 410 of the button opening of the cover, the fulcrum 423 of the valve beam presses against the inner fulcrum surface 411 on the wall opposite the button, and the extended arm 424 presses the orifice seal 427 against the inner drinking orifice surface 412. In this position, the single piece valve beam 420 is deflected between the button and fulcrum end providing the spring force to linearly press the button seal 426 against the button opening inner surface 410 and rotationally press the orifice seal 427 against the inner drinking orifice surface 412. Since both the orifice seal 427 and the button seal 426 are made of elastic material, the drinking orifice 402 and the button opening 403 simultaneously seal from the deflection force of the valve beam. To achieve a leak-proof sealed vessel, the container seal 415 assembles to the cover assembly 400 once pressed over the cover threads 405 and seals against the container seal surface of the cover 404. When the cover assembly 400 is rotationally attached to the container 430, the container seal 415 is captured between the container seal surface of the cover 404 and the container seal surface 432 forming a sealed vessel.

The cover 401 may have an appendage or loop to attach a carabineer clip to hold the vessel to a backpack or briefcase. This appendage could be molded into the cover 401 or added as a separate piece.

The valve is actuated, as shown in FIG. 5, by pressing the button 522 horizontally on the single piece valve beam 520, which deflects the beam away from the drinking orifice 502, releasing the seal 526 from the inner surface 510 of the button opening which vents the sealed vessel, and the fulcrum end 523 of the beam rotates clockwise about the inner fulcrum surface 511 located in a corner of an inner region on the inside of the cover causing the extended arm 524 and orifice seal 527 to rotate clockwise away from the inner drinking orifice surface 512, opening the drinking orifice 502. The single piece valve beam 520 has an integrally formed arm 524 extended or cantilevered off of the single piece valve beam from a location near the fulcrum 523 such that, when the button 522 is pressed, the integrally formed arm 524 rotates relative to said location near the inner fulcrum surface 511 in a same direction as the single piece valve beam rotates at the fulcrum. The media within the vessel can now be poured out of the drinking orifice 502 with the unsealed button opening 503 acting as a back vent for the released media. The vessel must be held by a user such that the button opening 503 is vertically higher than the drinking orifice 502 when drinking or pouring to allow for the back venting. Releasing the button 522 returns the valve beam 520 to the unactuated mode shown in FIG. 4.

Figure 6:
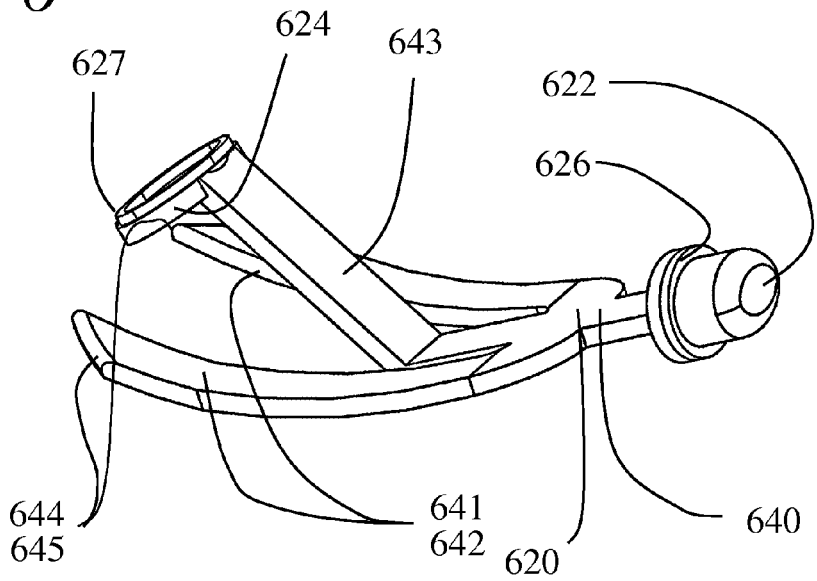
FIG. 6 illustrates a perspective view of a valve beam of a third, finger embodiment according to the present inventions.
Figure 7:
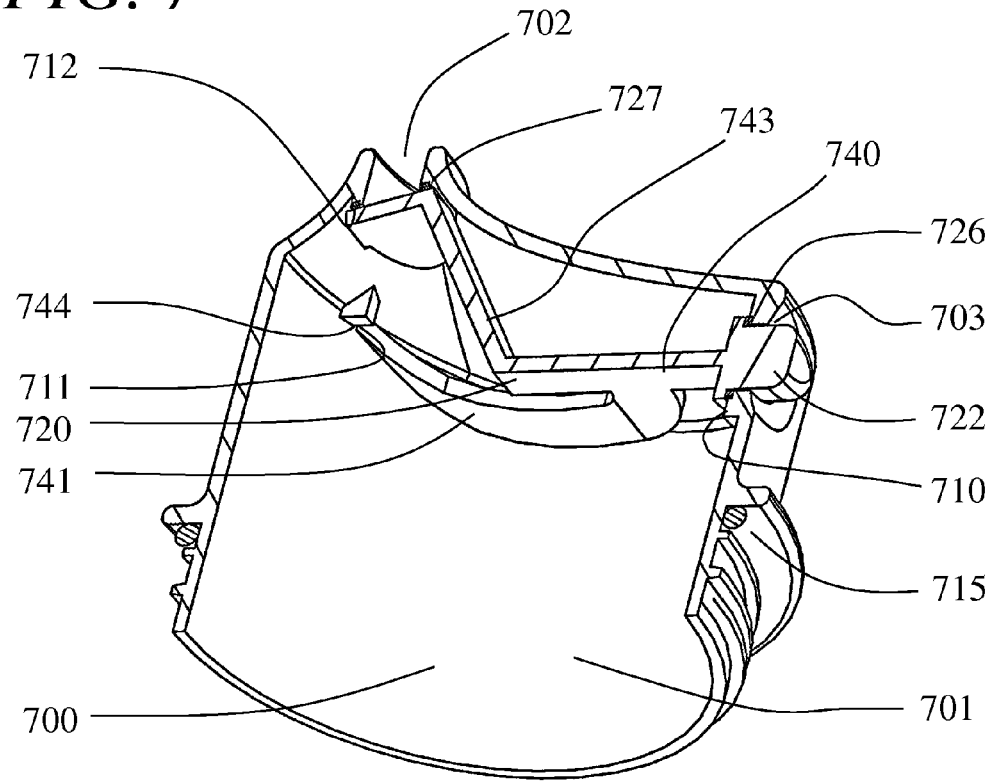
FIG. 7 illustrates a cross section perspective view of a cover assembly with a valve of the third, finger embodiment in an unactuated mode according to the present inventions.

FIG. 6 illustrates a perspective view of a valve beam 620 of a third, finger embodiment. FIG. 7 illustrates a cross section perspective view of a cover assembly 700 of the third, finger embodiment in an unactuated mode and FIG. 8 illustrates a cross section perspective view of a cover assembly 800 of the third, finger embodiment in an actuated mode.

Figure 8:
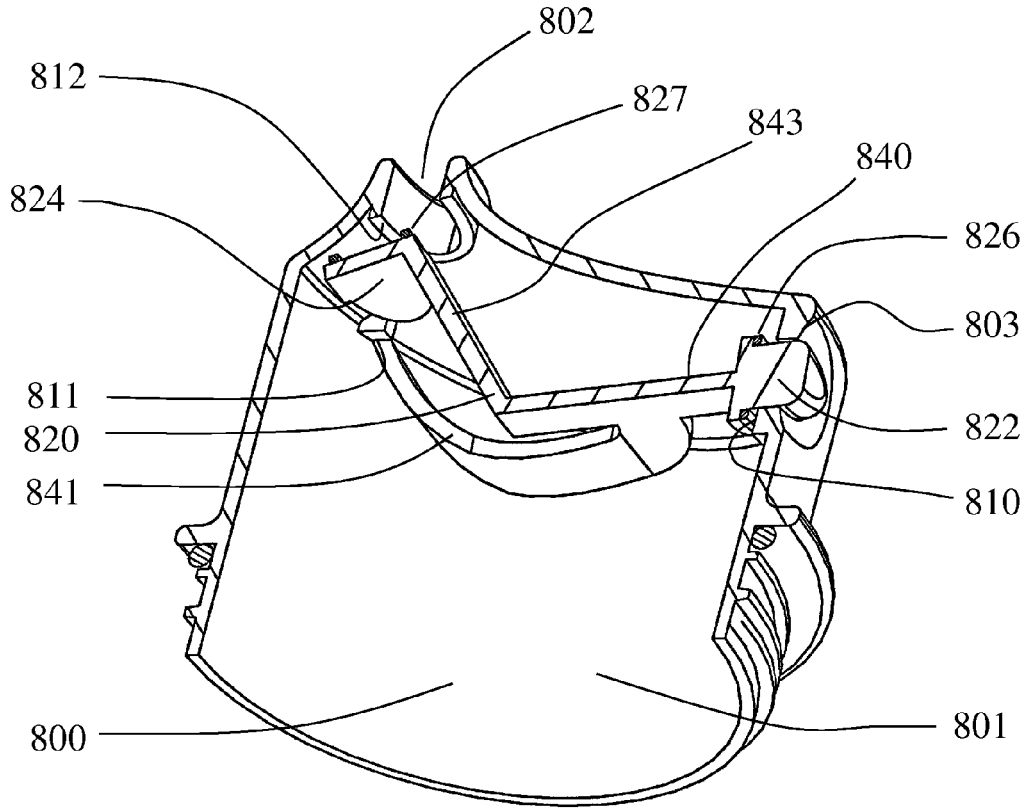
FIG. 8 illustrates a cross section perspective view of a cover assembly with a valve of the third, finger embodiment in an actuated mode according to the present inventions.

In the third, finger embodiment of FIGS. 6, 7 and 8, the drinking orifice 702 is transversely located from the button opening 703 in the cover and a cantilevered arm extension 743 of the valve beam moves away from the drinking orifice 702 when the button 722 is pressed. The valve beam 720 opposite the button is divided into a pair of deflection fingers 741 which presses against the inside wall of the cover which deflect to press against the button opening 703 and a separate cantilevered arm 743 seals the drinking orifice 702. When the button is pressed horizontally, the valve beam 720 deflects vertically, causing the cantilevered arm 743 to move away from the drinking orifice 702 to thereby open the drinking orifice 702.

The integrally formed arm 743 is cantilevered off of the single piece valve beam from a stem location. The stem location is cantilevered operatively closer to the actuator button 722 than the fulcrum 744 such that, when the actuator button 722 is pressed, the integrally formed arm 743 rotates in a direction opposite a direction to which the single piece valve beam rotates at the fulcrum 744.

The valve beam 620 in FIG. 6 illustrates a bendable, rigid plastic material with a button 622 that has a ledge for a button seal 626 of an elastic material for sealing the button opening. The button 622 is attached to a rigid section 640 of the valve beam which divides into a pair of deflection fingers 641 and 642 and a cantilevered arm 643 at a stem location. The deflection fingers 641 and 642 extend from the rigid section 640 of the valve beam 620 to the fulcrums 644 and 645 located substantially opposite the button 622. The cantilevered arm 643 extends from the rigid section 640 of the valve beam 620 and includes a projection 624 for the drinking orifice seal 627.

The valve beam 620 could be made in multiple forms accomplishing the same result by connecting the two or more deflection fingers 641 and 642 with an extension to add more rigidity. The valve beam could also be made with only one deflection finger or be made with an extension at the fulcrum end to balance the valve beam during actuation.

In an unactuated mode as shown in FIG. 7, the single piece valve beam 720 is positioned within the cover 701 such that the button 722 is extending through the button opening 703 in the cover 701 with the button seal 726 pressed against the inner surface 710 of the button opening. The rigid section 740 of the valve beam divides the pair of deflection fingers 741 and a cantilevered arm 743 at the stem location, such that the fulcrum 744 therefore presses against the inner fulcrum surface 711 located in a corner of an inner region on an inside of the cover and the cantilevered arm 743 presses the orifice seal 727 against the inner drinking orifice surface 712. In this position, the deflection of the pair of fingers 741 provide the spring force to seal the button seal 726 against the inner button surface 710 while the vertical deflection of the cantilevered arm 743 provides the spring force to seal the orifice seal 727 against the inner drinking orifice surface 712. As with the previous described embodiments, the cover assembly 700 is rotationally attached to a container with the container seal 715 providing a seal between the cover assembly and the container, thereby providing a sealed vessel.

The valve is actuated, as shown in FIG. 8, by pressing the button 822, such that the button 822 travels though the button opening 803 in the cover 801, unseating the button seal 826 from the inside button surface 810 of the cover which releases any internal pressure from the vessel. As shown in FIG. 8, the valve beam 820 deflects such that the rigid section 840 of the beam rotates counter clockwise away from the drinking orifice 802 when the button is pressed, while the pair of deflection fingers 841 deflects and rotates clockwise about the inner fulcrum surface 811 located in a corner of an inner region on the inside of the cover causing the cantilevered arm 843 to rotate away from the drinking orifice, pulling the orifice seal projection 824 and orifice seal 827 away from the inner drinking orifice surface 812, opening the drinking orifice 802. The media within the vessel can now be poured out of the drinking orifice 802 with the unsealed button opening acting as a back vent for the released media. The vessel must be held by a user such that the button 822 is vertically higher than the drinking orifice 802 when drinking to allow for the back venting. Releasing the button 822 returns the valve beam 820 to the unactuated mode shown in FIG. 7.

Besides being of lower cost and having an advantage of disposability, one or more embodiments of the present inventions solve problems of cleaning the valve and valve mechanisms in part because they are removable. Previously coffee stains or residue would build up in the mechanism. All of the first, second, and third embodiments allow for the valve beam to be easily removed by pulling on an access arm, which allows for easy cleaning and access to all surfaces in contact with the drinking fluid. The valve beam can be easily removable without an access arm as well by allowing for finger access to remove the valve beam.

One or more embodiments of the present inventions also solve the problems of release of pressure to atmosphere. Previously, when opened, some would cause liquid to squirt out. One or more embodiments of the present inventions vent to atmosphere at the button and provide a pre-release to atmospheric pressure to abate this squirting.

All of the first, second, and third embodiments can be made using 'two part injection' molded of plastic and foam to be fitted together for the valve beam. The valve beam could also be made from spring steel with a seal pad attached to the valve beam.

Although the invention described references a sealed vessel for drinking, the same approach can be applied to larger vessels and non-liquid media. Also, the method of actuation could be changed to centrally locate the button on the vessel by adding a mechanism to remove the valve beam.

Unless stated otherwise, terms such as "first" and "second" are used to arbitrarily distinguish between the elements such terms describe. Thus, these terms are not necessarily intended to indicate temporal or other prioritization of such elements.

Any trademarks listed herein are the property of their respective owners, and reference herein to such trademarks is generally intended to indicate the source of a particular product or service.

Although the inventions have been described and illustrated in the above description and drawings, it is understood that this description is by example only, and that numerous changes and modifications can be made by those skilled in the art without departing from the true spirit and scope of the inventions. Although the examples in the drawings depict only example constructions and embodiments, alternate embodiments are available given the teachings of the present patent disclosure.

What is claimed is:

1. A cover assembly for a container, comprising:

a cover capable of attaching to a container and comprising a dispensing orifice for dispensing media from the container and a button opening accommodating an actuator button on a side of the cover, the cover comprising an inner fulcrum surface opposite the button opening accommodating a fulcrum; and a single piece valve beam formed of a deflectable material and comprising the actuator button including an actuator sealing surface for the actuator button located on one end of the single piece valve beam, comprising the fulcrum located on another end opposite the actuator button and comprising a dispensing sealing surface for the dispensing orifice located away from the one end, wherein the single piece valve beam is held between the button opening and the inner fulcrum surface by the deflection of the single piece valve beam while sealing the actuator button and the dispensing orifice, when the actuator button is pressed, the single piece valve beam further deflects and rotates about the fulcrum on the inner fulcrum surface, opening both the dispensing orifice and the button opening.

2. A cover assembly according to claim 1, wherein the single piece valve beam comprises a seal pad at the dispensing sealing surface that mates with and seals the dispensing orifice.

3. A cover assembly according to claim 2, wherein the single piece valve beam comprises a seal pad around the actuator button at the actuator sealing surface that mates with and seals the button opening.

4. A cover assembly according to claim 3, wherein the single piece valve beam is integrally formed by a two part injection mold process by a pliable material for the seal pads and a deflectable hard plastic material.

5. A cover assembly according to claim 1, wherein the single piece valve beam comprises an access arm handle for the pulling for removal.

6. A cover assembly according to claim 1, wherein the dispensing orifice is on a top of the cover substantially perpendicular to the button opening on the side of the cover.

7. A cover assembly according to claim 1, wherein the single piece valve beam is pulled to deflect the single piece valve beam further than merely pressing the actuator button until the valve beam is removed from the cover.

8. A cover assembly according to claim 1, wherein the dispensing sealing surface is longitudinally positioned near a midpoint of the single piece valve beam.

9. A cover assembly according to claim 1, wherein the single piece valve beam comprises an integrally formed arm and wherein the dispensing sealing surface is on said integrally formed arm.

10. A cover assembly according to claim 9, wherein the integrally formed arm rotates to open the dispensing orifice when the actuator button is pressed.

11. A cover assembly according to claim 9, wherein the integrally formed arm is cantilevered off of the single piece valve beam from a location such that, when the actuator button is pressed, the integrally formed arm rotates in a same direction as the single piece valve beam rotates at the fulcrum.

12. A cover assembly according to claim 11, wherein the integrally formed arm is cantilevered off of the single piece valve beam at a location operatively closer to the fulcrum than the actuator button.

13. A cover assembly according to claim 9, wherein the integrally formed arm is cantilevered off of the fulcrum.

14. A cover assembly according to claim 9, wherein the integrally formed arm is cantilevered off of the single piece valve beam from a stem location such that, when the actuator button is pressed, the integrally formed arm rotates in a direction opposite a direction to which the single piece valve beam rotates at the fulcrum.

15. A cover assembly according to claim 14, wherein the integrally formed arm is cantilevered off of the single piece valve beam at a location operatively closer to the actuator button than the fulcrum.

16. A cover assembly for a container, comprising:

a cover capable of attaching to a container and comprising a dispensing orifice for dispensing media from the container and a button opening capable of accommodating an actuator button on a side of the cover, the cover comprising an inner region including a retention surface opposite the button opening capable of accommodating a fulcrum; and a single piece valve beam formed of a deflectable material and comprising the actuator button located on one end of the single piece valve beam, the fulcrum located on another end opposite the actuator button and a dispensing sealing surface for the dispensing orifice located away from the one end, wherein the single piece valve beam is held inside the inner region of the cover between the button opening and the retention surface and the single piece valve beam has a shape sufficient to cause deflection of the single piece valve beam and rotation about the fulcrum against the retention surface such that the dispensing sealing surface moves away from the dispensing orifice when the actuator button is pressed;

wherein the single piece valve beam comprises an integrally formed arm and wherein the dispensing sealing surface is on said integrally formed arm; and wherein the single piece valve beam comprises two fingers, each finger having a fulcrum which presses against the retention surface of the cover.

17. A cover assembly according to claim 16, wherein the integrally formed arm is cantilevered off of the single piece valve beam from a stem location operatively closer to the actuator button than the fulcrum.

18. A cover assembly according to claim 9, wherein the single piece valve beam comprises two fingers, both of the two fingers providing said fulcrum which presses against the inner fulcrum surface of the cover.

19. A cover assembly according to claim 18, wherein the integrally formed arm is cantilevered off of the single piece valve beam from a stem location operatively closer to the actuator button than the fulcrum.

20. A cover assembly according to claim 1, wherein the single piece valve beam comprises an actuator button end and a fulcrum end and wherein the fulcrum end is located at a distant end opposite the actuator button end; and wherein the inner fulcrum surface is located in a corner of an inner region on an inside of the cover diametrically opposite a location of the cover where the button opening is located.

21. A cover assembly according to claim 1, wherein in the dispensing orifice is above the single piece valve beam between the button opening and the inner fulcrum surface.

22. A cover assembly according to claim 1, wherein the single piece valve beam simultaneously deflects both substantially horizontally and substantially vertically and rotates about the fulcrum against the inner fulcrum surface such that the dispensing sealing surface moves vertically away from the dispensing orifice when the actuator button is substantially horizontally pressed.

23. A vessel, comprising:

a container; and a cover assembly for covering the container, the cover assembly comprising:

a cover capable of attaching to the container and comprising a dispensing orifice for dispensing media from the container and a button opening accommodating an actuator button on a side of the cover, the cover comprising an inner fulcrum surface opposite the button opening accommodating a fulcrum; and a single piece valve beam formed of a deflectable material and comprising the actuator button including an actuator sealing surface for the actuator button located on one end of the single piece valve beam, comprising the fulcrum located on another end opposite the actuator button and comprising a dispensing sealing surface for the dispensing orifice located away from the one end, wherein the single piece valve beam is held between the button opening and the inner fulcrum surface by the deflection of the single piece valve beam while sealing the actuator button and the dispensing orifice, when the actuator button is pressed, the single piece valve beam further deflects and rotates about the fulcrum on the inner fulcrum surface, opening both the dispensing orifice and the button opening.

* * * * *